United States Patent [19]

Millette

[11] Patent Number: 4,779,301

[45] Date of Patent: Oct. 25, 1988

[54] SCRAPER

[76] Inventor: Edgar Millette, 171, Ch. St-Ours, Sorel, Canada, J3P 2L4

[21] Appl. No.: 45,295

[22] Filed: May 4, 1987

[51] Int. Cl.[4] ..... A47L 13/08

[52] U.S. Cl. ..... 15/105; 15/263.01; 30/169

[58] Field of Search ..... 15/236 R, 105; 30/169, 30/172

[56] References Cited

U.S. PATENT DOCUMENTS

| | | | |
|---|---|---|---|
| 1,333,745 | 3/1920 | Wescott | 117/1 C |
| 1,354,709 | 10/1920 | Williams | 30/169 |
| 1,367,032 | 2/1921 | Ferdon | 30/136 |
| 1,919,351 | 7/1933 | Willadsen | 30/172 X |
| 2,008,952 | 7/1935 | Gach | 15/236 R |
| 2,484,476 | 10/1949 | Teigland | 30/172 |
| 3,818,593 | 6/1974 | Oliverius | 30/169 |
| 4,418,439 | 12/1983 | Porchet | 15/236 R |
| 4,549,350 | 10/1985 | Patillo | 15/236 R X |

FOREIGN PATENT DOCUMENTS

| | | | |
|---|---|---|---|
| 905207 | 4/1945 | France | 15/236 R |
| 121420 | 12/1918 | United Kingdom | 15/236 R |
| 508888 | 7/1939 | United Kingdom | 15/236 R |

*Primary Examiner*—Chris K. Moore

*Attorney, Agent, or Firm*—Robic, Robic & Associates

[57] ABSTRACT

A scraper for removing material, adhered to a surface, in strips. The scraper has a front scraping edge and at least one cutting edge at one end of the scraping edge. The cutting edge extends generally transverse to the scraping edge.

11 Claims, 4 Drawing Sheets

SCRAPER

BACKGROUND OF THE INVENTION

(1) Field of the Invention

The present invention relates to a scraper and more particularly to a scraper for use to remove material, such as wallpaper or carpet, adhered to a wall or floor.

(b) Brief Description of the Prior Art

Known scrapers employed to remove material adhered to a surface have a front scraping edge. When removing material, sufficient force must be applied to not only lift free the material directly in front of the scraper, but also the material at both sides of the scraper. In addition, sufficient force must be applied to tear portions of the material to be removed from portions still adhered to the surface. Thus scraping with a known scraper can be very tiring. In addition some material, such as carpet, does not tear so that it must be cut in separate operations to remove loosened portions, or it must be slowly worked at to loosen it so that it can be removed in one piece. In either case, additional effort is required.

SUMMARY OF THE INVENTION

The object of the present invention is to provide a novel scraper which makes it easier to remove adhered material.

In accordance with the present invention, this object is achieved with a scraper which is designed to focus the scraping effort only in front of the scraper, and not to waste any scraping effort to the sides of the scraper. For this purpose, the scraper according to the invention is provided with at least one, and preferably two cutting blades extending transverse to the scraper blade, one on each side of the scraper. As the scraper is pushed forwardly, the cutting blades cut the material into a strip equal in width to the width of the scraper blades. Thus, only the material directly in front of the scraper need be loosened making the scraping job much easier and quicker.

The invention as broadly claimed hereinafter is particularly directed toward a scraper having a sharpened, front scraping edge and at least one sharpened cutting edge at one end of the scraping edge, this cutting edge extending generally transverse to the scraping edge.

The invention as claimed hereinafter is more particularly directed toward a scraper comprising: a scraping blade having a front scraping edge; a handle connected to the scraping blade, said handle extending rearwardly of said scraping blade; at least one cutting blade having a front cutting edge; and means for mounting said at least one cutting blade on one side of the scraping blade with the cutting edge of said cutting blade extending generally transverse to said front scraping edge.

According to a preferred embodiment of the invention, the scraper further comprises a blade mounting member supporting the rearwardly extending handle; and means for mounting the scraping blade onto said mounting member with the front scraping edge of said scraping blade projecting forwardly of said mounting member.

According to another preferred embodiment of the invention, the mounting means are of the detachable type and comprise for each cutting blade: a dihedral mounting brace having one arm detachably connected to the scraping blade and another arm extending perpendicular to the one arm, said other arm being provided with a central threaded hole; a C-shaped mounting plate sized to fit over the other arm of the brace, said mounting plate having a central trough hole aligned with the threaded hole of the brace; and a locking screw passing through said through hole and engaging said threaded for tightening the mounting plate to the mounting brace with the cutting blade sandwiched therebetween.

BRIEF DESCRIPTION OF THE DRAWINGS

Other aspects and advantages of the present invention will be better understood upon reading the following non-restrictive description of three embodiments thereof, having reference to the accompanying drawings in which.

DESCRIPTION OF THREE PREFERRED EMBODIMENTS

Figure 1:
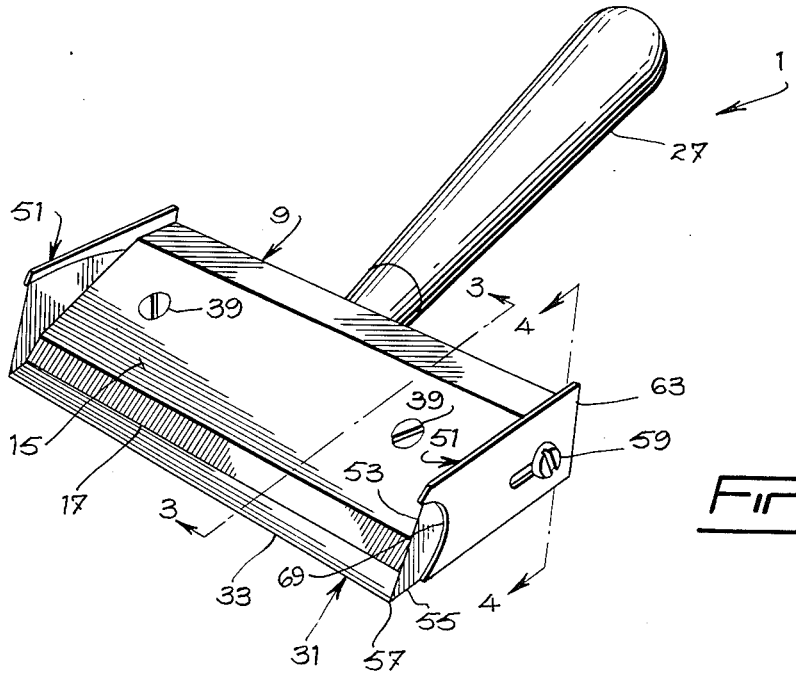
FIG. 1 is a perspective view of a scraper according to a first embodiment of the invention.
Figure 2:
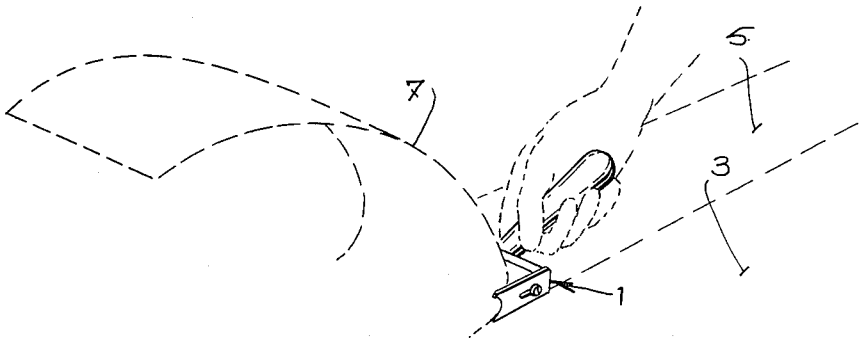
FIG. 2 is a view of the scraper of FIG. 1 in use.
Figure 3:
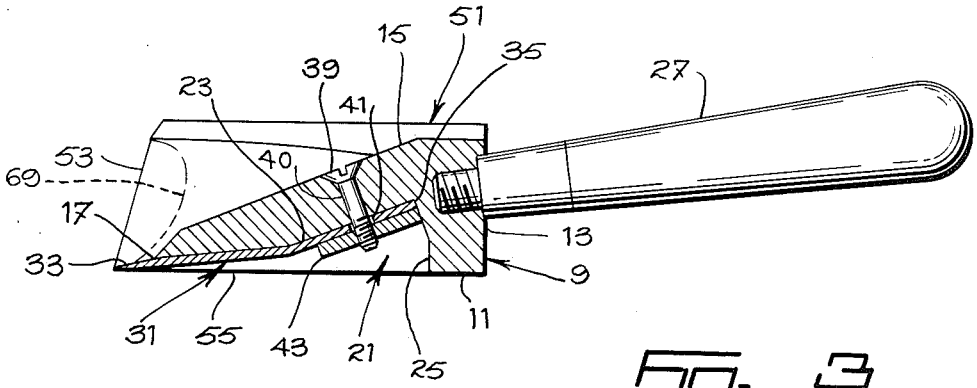
FIG. 3 is a cross-section view taken along line 3—3 in FIG. 1.
Figure 4:
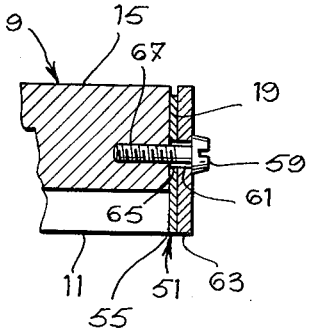
FIG. 4 is a cross-section view taken along line 4—4 in FIG. 1.

The scraper 1 according to the first embodiment of the invention as shown in FIGS. 1 to 4, is intended to be used to scrape material, such as glued carpet 3, off a base surface 5 in strips 7. The scraper 1 comprises a blade mounting member 9, comprising a block of rigid material. The mounting member 9, as shown in FIG. 3, has a flat bottom surface 11, a rear surface 13, a forwardly sloping top surface 15 that terminates in a front edge 17, and parallel end surfaces 19 as shown in FIG. 4, that extend perpendicular to the other surfaces. The bottom surface 11 is recessed as shown at 21 to provide a forwardly sloping bottom mounting surface 23 and a stop surface 25 that extends at an angle with respect to the mounting surface 23 and to the bottom surface 11. A handle 27 is attached to the mounting member 9, centrally located in the rear surface 13, and extending rearwardly of the mounting member 9. The handle 27 is generally aligned with the mounting surface 23.

The scraper 1 also comprises a scraping blade 31 with a straight, sharpened scraping edge 33 on its front end. The blade 31 is generally rectangular in shape and is sized to fit in the recess 19 on the mounting member 9 with its back edge 35 abutting the stop surface 23, and with its front, scraping edge 33 projecting just forwardly of the tapered front edge 17 of the mounting block 9. A pair of screws 39 pass through holes 40 provided in the mounting member 9, and through holes 41 provided in the scraping blade 31 to thread into a mounting plate 43. When the screws 39 are tightened, the mounting plate 43 firmly holds the scraping blade 31 against the bottom mounting surface 23 of the mounting member 9.

The scraper 1 has at least one transverse cutting blade 51. Preferably, however, the scraper 1 is provided with a cutting blade on each side as shown. Since both are identical, only one will be described in detail. The cutting blade 51 is generally rectangular in shape and has an angled front cutting edge 53. The blade 51 is adapted to be mounted against one end surface 19 of the mounting member 9 with its bottom edge 55 flush with the bottom surface 11 of the mounting member 9. The lower point 57 of the front cutting edge 53 is generally adjacent the end of the scraping edge 33 of the scraping blade 31. The cutting blade 51 in its mounted position extends transverse to the scraping blade 31. A mounting screw 59 is passed through an elongated hole 61 in a mounting plate 63 and a hole 65 in the cutting blade 51 to screw into a threaded hole 67 in the mounting member 9. When the screw 59 is tightened, the mounting plate 63 firmly holds the cutting blade 51 in position. The elongated hole 61 allows the mounting plate 63 to be moved relative to the blade 51 so as to locate its front edge 69 close to the cutting edge 53 of the blade 51 to keep the blade 51 rigid.

In use, the scraper 1 is pushed forwardly against a surface 5 to scrape material 3, that is adhered to the surface, off the surface. The scraping edge 33 of the scraping blade 31 scrapes the material 3 off the surface 5 while the cutting edge 53 of the cutting blades 51 simultaneously cuts the material 3 into easily removable strips 7. The pushing action is exerted on the scraper and not on material extending past the sides of the scraper which would be the case if the cutting blades were omitted.

Figure 5:
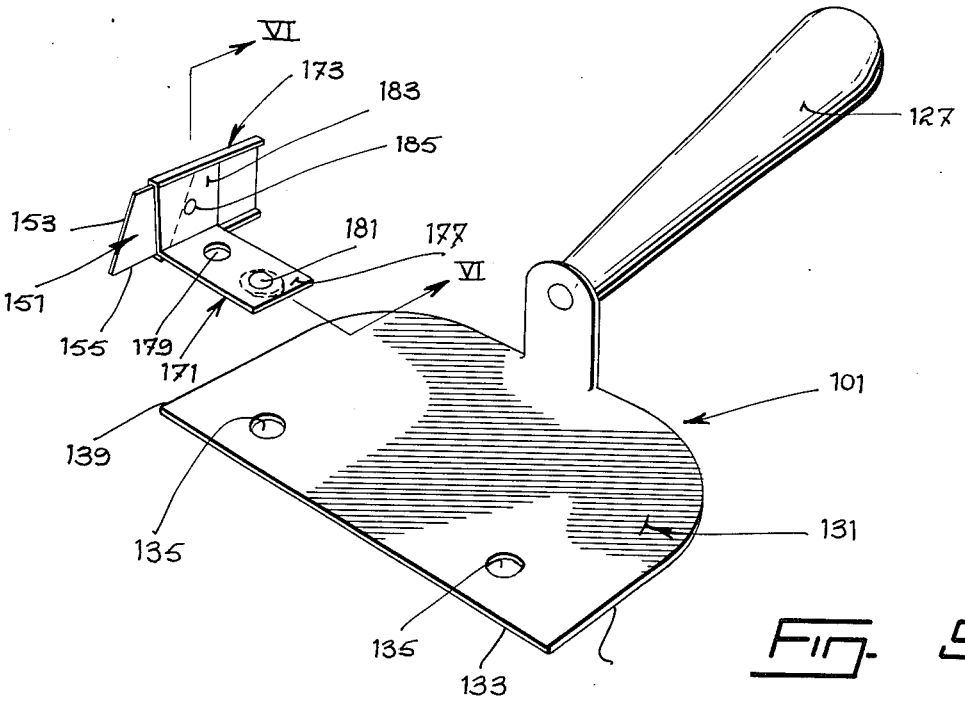
FIG. 5 is a perspective view of a scraper according to a second embodiment of the invention, with its lateral cutting blade shown apart.
Figure 6:
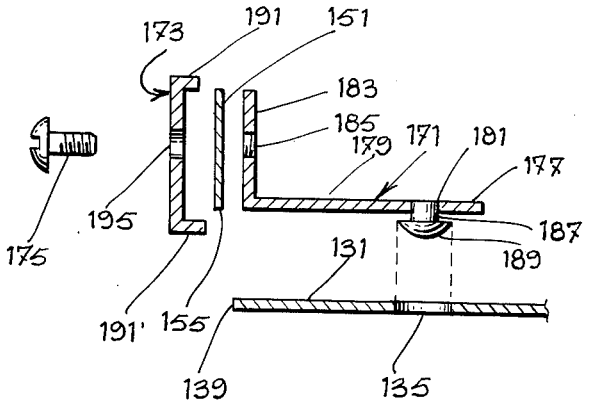
FIG. 6 is an exploded, cross-section view of the lateral cutting blade of the scraper of FIG. 5, taken along lines VI—VI of said FIG. 5.
Figure 7:
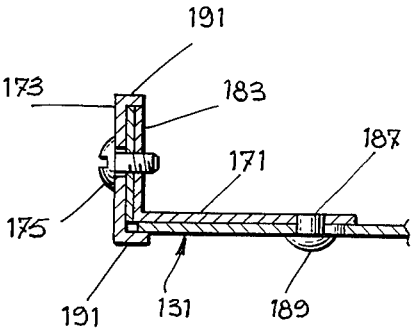
FIG. 7 is a cross-section view similar to the one of FIG. 6, showing the lateral cutting blade set in position.

The scraper 101 according to the second embodiment of the invention as shown in FIGS. 5 to 7, comprises a large scraping blade 131 provided with a straight, sharpened scraping edge 135 on its front end. The blade 131 is rearwardly extended by a handle 127 centrally attached to its rear end. The blade is also provided with a through hole 135 on each side, each hole extending at the same predetermined distances from the adjacent front edge 133 and corresponding lateral edge 139 of the blade.

The scraper 101 also comprises at least one, but preferably two cutting blades 151 extending transverse to the scraping edge 133, one on each side of the blade 131. Each cutting blade 151 is generally rectangular in shape and has an angled front cutting edge 153. Each cutting blade 151 is also adapted to be mounted on the scraping blade 131 in such a manner as to extend transverse one lateral edge 139 of said blade 131 with the bottom edge 155 of the cutting blade 151 flush with the top surface of the blade 131.

Mounting means are provided for detachably yet rigidly mounting each cutting blade 151 in its operative transverse position on the scraper blade 131. These mounting means comprise a dihedral mounting brace 171, a C-shaped mounting plate 173 and a locking screw 175. The dihedral brace 171 has an elongated arm 177 provided along its length with two spaced apart perforations 179 and 181, and a short arm 183 provided in its middle with a threaded hole 185 sized to receive the screw 175. The elongated arm 177 is long enough to reach and extend over the hole 135 of the scraping blade 131 when the short arm 183 extends flush with the closest lateral edge 139. Perforation 179 of the elongated arm 177 is left free. Perforation 181 which is positioned along the arm 177 in such a manner as to extend above the hole 135 when the short arm 182 is flush with the edge 139 (see FIG. 6), is however closed by the stem 187 of a small screw which is welded therein and has a rounded head 189 of substantially the same diameter as the hole 135. The head 189 of the welded screw extends from the bottom surface of the arm 177 at a distance substantially equal to the thickness of the scraping blade 131.

The short arm 183 of the brace 171 extends perpendicular to the elongated arm 177 and is of substantially the same height as the cutting blade 151, as clearly shown in FIG. 6.

The C-shaped mounting plate 173 is adapted to fit over the short arm 183 of the brace 171 with the cutting blade 151 sandwiched therebetween as shown in FIGS. 6 and 7. The plate 173 comprises a vertical wall high enough to simultaneously cover the arm 183 of the brace 171 against which bears the cutting blade 151, and the edge 139 of the scraping blade 139 when the arm 177 of the brace 171 is flush with the upper surface of this blade. The plate 173 also comprises a pair of small projecting flanges 191, 191' extending along its top and bottom edges respectively, and a central through hole 195 provided in its vertical wall so as to be in substantial alignment with the hole 185 of the arm 183 when the fixation device is set.

Mounting of a cutting blade 151 onto the scraping blade 131 is made as follows.

In a first step, the brace 171 is placed onto the scraping blade 131 and moved in such a manner that the head 189 of the small welded screw projecting from the bottom of the elongated arm 177 enters a selected hole 135 and passes therethrough.

Then, the blade 131 whose elongated arm 177 now extends flush with the upper surface of the blade 131, is orientated so that its short arm 183 is parallel and adjacent to the edge 139. The cutting blade 151 is placed against the short arm 183 and the C-shaped plate 173 is placed over them to sandwich the blade 151 with the hole 195 aligned with the hole 185. Last of all, the screw 175 is set and tightened to fix the plate 173 to and over the arm 183 of the brace and the adjacent edge 139 of the scraping blade 131. As the screw is tightened, the brace 171 starts to move laterally until the stem 187 comes into contact with the wall of the hole 135. Simultaneously, the upper and lower flanges 191, 191' move snuggly above and under the upper edge of the arm 183 and the lower surface of the edge 139 of the scraping blade 135, as clearly shown in FIG. 7.

When this tightening operation is achieved, the mounting means and cutting blade attached thereto are rigidly set onto the scraping blade 135. Both the head 189 of the welded screw which is pulled under the blade 135 and acts as a hook and the flanges 191, 191' of the mounting plate 173 prevent the device and cutting blade 151 from being torn up. Both of them also prevent the mounting means and cutting blade 151 from moving rearwardly on rotating about the stem 187.

As aforesaid, another cutting blade 151 can be mounted on the other side of the scraping blade 139. Of course, similar mounting means can be used to do so. Each cutting blade 151 may be perforated as the blade 51 of the first embodiment disclosed hereinabove, its perforation being sized to give room to the screw 175. This feature however is not compulsory if the blade is short enough to extend in front of the screw 175, as shown in FIG. 5. In such a case, the screw 175 merely acts as a stop against any rearward movement of the blade 151.

Figure 8:
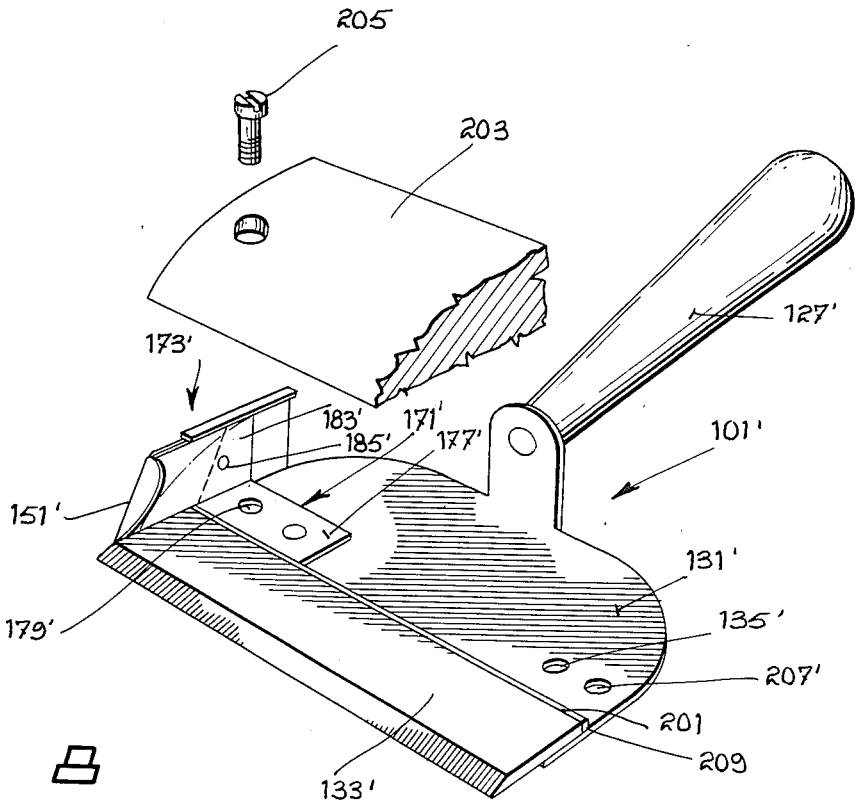
FIG. 8 is an exploded perspective view of a scraper according to a third embodiment of the invention.
Figure 9:
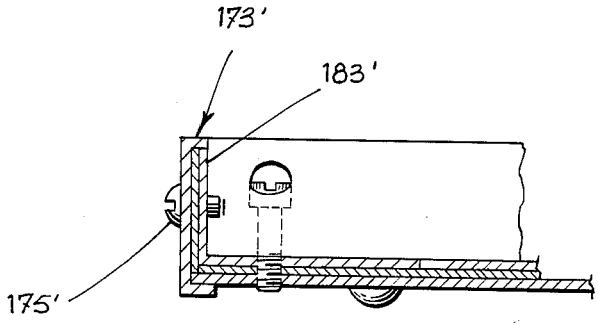
FIG. 9 is a cross-section view of the lateral edge of the scraper of FIG. 8, taken along lines IX—IX of said FIG. 8.

The scraper 101' according to the third embodiment of the invention as shown in FIGS. 8 and 9 is only a variant of the scraper shown in FIGS. 5 to 7. For this reason, the same reference numerals provided with a distinguishing prime (') have been used in the drawings for identifying the same structural elements.

The scraper 101' differs from the scraper 101 in that its scraping blade 131' is provided with a detachable front scraping edge 133'. The edge 133' extends forwards and bears against a small upwardly projecting stop bead 201 forming an integral part of the blade 131'. The scraping edge 133' is held in position by means of a wedge-shaped cap 203 that can be screwed onto top of both of the scraping edge 133' and scraping blade 131' by means of a pair of bolts 205 screwable into threaded holes 207 provided in the blade 131', rearwardly of the stop bead 201.

In this embodiment, one or preferably two lateral cutting blades 151' are provided transverse to the scraping edge 133'. Such blades 151' are mounted onto the scraping blade 131' with mounting means similar to the one previously described, i.e. means comprising a dihedral mounting brace 171', a C-shaped mounting plate 173' and a locking screw 175'. The holes 135' used to position these mounting means are positioned adjacent the holes 207, rearwardly of the stop bead 201. The perforation 179' of the arm 177' of each brace 171' is positioned along this arm in such a manner as to be coaxial with the adjacent threaded hole 207 when the cutting blade 151' is fixed, to let the bolt 205 free to pass and engage the hole 207.

Advantageously, the ends 209 of the stop-bead 201 are cut to let the cutting blade 151 pass over and bear on top of the lateral edge of the scraping edge 133', thereby pinching the same and preventing the edge 133' from being laterally torn up.

In the above specification as well as in the appended claims it must of course be understood that instead of using a threaded hole 185 in the brace 171 and a through hole 195 in the plate 173, use may alternatively be made of a through hole in the brace 171 and a threaded hole in the plate 173 to receive and set the screw 175. In such a case, the screw 175 will be inserted in the direction opposite to the one shown in the accompanying drawings.

I claim:

1. A scraper comprising:

a scraping blade having a front scraping edge;

a handle connected to the scraping blade, said handle extending rearwardly of said scraping blade;

at least one cutting blade having a front cutting edge; and means for mounting said at least one cutting blade on one side of the scraping blade with the cutting edge of said cutting blade extending generally transverse to said front scraping edge, wherein said mounting means are of the detachable type and comprise for each of said at least one cutting blade:

a dihedral mounting brace having one arm detachably connected to the scraping blade and another arm extending perpendicular to the one arm, said other arm being provided with a central threaded hole;

a C-shaped mounting plate sized to fit over the other arm of the brace, said mounting plate having a central trough hole aligned with the threaded hole of the brace; and a locking screw passing through said through hole and engaging said threaded hole for tightening the mounting plate to the mounting brace with the cutting blade sandwiched therebetween.

2. A scraper as claimed in claim 1 wherein:

the one arm of the mounting brace comprises a downwardly projecting hook for use to connect it to the scraping blade, said hook engaging a hole provided in said scraping blade; and said C-shaped mounting plate comprises a vertical wall and a pair of small upper and lower projecting flanges vertically spaced apart to such an extent as to snugly extend above the other arm of the brace and under the scraping blade, respectively.

3. A scraper as claimed in claim 2, comprising two cutting blades mounted on the one and the other sides of said scraping blade, respectively.

4. A scraper as claimed in claim 3, wherein the cutting edge of each cutting blade is generally adjacent the front cutting edge.

5. A scraper as claimed in claim 4, wherein the front scraping edge is detachably mounted on the scraping blade and wherein said scraper further comprises:

a stop bead upwardly projecting from the scraping blade to prevent the scraping edge from moving rearwardly; and a wedge-shaped cap screwed on top of the scraping blade to hold the front scraping edge in position.

6. A scraper as claimed in claim 2, wherein the front scraping edge is detachably mounted on the scraping blade and wherein said scraper further comprises:

a stop bead upwardly projecting from the scraping blade to prevent the scraping edge from moving rearwardly; and a wedge-shaped cap screwed on top of the scraping blade to hold the front scraping edge in position.

7. A scraper comprising:

a scraping blade having a front scraping edge;

a handle connected to the scraping blade, said handle extending rearwardly of said scraping blade;

at least one cutting blade having a front cutting edge; and means for mounting said at least one cutting blade on one side of the scraping blade with the cutting edge of said cutting blade extending generally transverse to said front scraping edge, wherein the front scraping edge is detachably mounted on the scraping blade and wherein said scraper further comprises:

a stop bead upwardly projecting from the scraping blade to prevent the scraping edge from moving rearwardly; and a wedge-shaped cap screwed on top of the scraping blade to hold the front scraping edge in position.

8. A scraper comprising:

a scraping blade having a front scraping edge;

a handle connected to the scraping blade, said handle extending rearwardly of said scraping blade;

a blade mounting member supporting the rearwardly extending handle;

means for mounting the scraping blade onto said mounting member with the front scraping edge of said scraping blade projecting forwardly of said mounting member;

at least one cutting blade having a front cutting edge; and means for mounting said at least one cutting blade on one side of the scraping blade with the cutting edge of said cutting blade extending generally transverse to said front scraping edge;

wherein said means for mounting said at least one cutting blade comprise a mounting plate with a central hole and a screw for fixing said mounting plate to one lateral side of the blade mounting member with the cutting blade sandwiched therebetween.

9. A scraper as claimed in claim 8, comprising two cutting blades mounted on the one and the other sides of said scraping blade, respectively.

10. A scraper as claimed in claim 9, wherein the cutting edge of each cutting blade is generally adjacent the front cutting edge.

11. A scraper as claimed in claim 10, wherein said cutting blade is perforated to let the fixation screw of the mounting means pass therethrough.

* * * * *